US009493272B2

(12) United States Patent
Hoedebeck et al.

(10) Patent No.: US 9,493,272 B2
(45) Date of Patent: Nov. 15, 2016

(54) FILM BAG

(71) Applicants: Markus Hoedebeck, Steinfeld (DE); Mark Gum, East Prairie, MO (US); Chris Simmers, Jackson, MO (US)

(72) Inventors: Markus Hoedebeck, Steinfeld (DE); Mark Gum, East Prairie, MO (US); Chris Simmers, Jackson, MO (US)

(73) Assignee: MONDI JACKSON, Inc, Jackson, MO (US)

( * ) Notice: Subject to any disclaimer, the term of this patent is extended or adjusted under 35 U.S.C. 154(b) by 0 days.

(21) Appl. No.: 14/099,058

(22) Filed: Dec. 6, 2013

(65) Prior Publication Data

US 2015/0158636 A1 Jun. 11, 2015

(51) Int. Cl.
*B65D 33/10* (2006.01)
*B65D 30/20* (2006.01)

(52) U.S. Cl.
CPC ..... *B65D 33/10* (2013.01); *B65D 31/10* (2013.01)

(58) Field of Classification Search
CPC ..... B65D 88/1681; B65D 88/1612; B65D 88/12; B65D 88/105; B65D 88/10; B65D 88/06; B65D 88/24; B65D 31/10; B65D 33/12; B65D 33/105; B65D 33/10; B65D 33/06; B65D 33/24
USPC ..... 383/17, 20, 21, 25
See application file for complete search history.

(56) References Cited

U.S. PATENT DOCUMENTS

| | | | | |
|---|---|---|---|---|
| 4,286,714 | A * | 9/1981 | Zdarsky et al. | 206/526 |
| 4,905,888 | A * | 3/1990 | Suoss et al. | 229/117.22 |
| 5,048,976 | A | 9/1991 | Jung | |
| 6,022,612 | A * | 2/2000 | Wilkie | 428/215 |
| 7,331,917 | B2 | 2/2008 | Totani | |
| 7,497,624 | B2 | 3/2009 | Totani | |
| 7,670,050 | B2 * | 3/2010 | Haimerl et al. | 383/28 |
| 7,775,957 | B2 | 8/2010 | Totani | |
| 8,267,579 | B2 * | 9/2012 | Kruse et al. | 383/26 |
| 8,414,188 | B2 * | 4/2013 | Koesters | 383/26 |
| 2006/0141883 | A1 * | 6/2006 | Nishiguchi et al. | 442/328 |
| 2008/0080794 | A1 * | 4/2008 | Kruse et al. | 383/14 |
| 2010/0129007 | A1 * | 5/2010 | McCoy et al. | 383/7 |
| 2011/0069912 | A1 * | 3/2011 | Waldron et al. | 383/75 |
| 2012/0163739 | A1 * | 6/2012 | Komro et al. | 383/120 |

FOREIGN PATENT DOCUMENTS

EP 1777167 A 4/2007

* cited by examiner

*Primary Examiner* — Peter Helvey
(74) *Attorney, Agent, or Firm* — Andrew Wilford

(57) ABSTRACT

A film bag has a body formed by a plurality of panels. All but one of the panels of the bag body is formed of an inelastic film, and the one panel of the bag body is formed at least partly by an elastic film that can be elastically stretched in at least one direction.

10 Claims, 4 Drawing Sheets

FILM BAG

FIELD OF THE INVENTION

The present invention relates to a film bag. More particularly this invention concerns a side-gusseted bag made of plastic film and having a side handle.

BACKGROUND OF THE INVENTION

The invention relates to a film bag having a bag body formed of a synthetic-resin or plastic film. The bag body usually has at least two face panels between which are opposite side gussets. In addition, the film bag can also be provided with a carry handle and a reclosable fastener in the form of a zipper or slide fastener.

In practice, film bags are used for different goods, so that bulk contents are well protected by the film bag body. In particular, film bags can be tightly sealed, resulting not only in improved protection but also a longer storage capability compared with paper packaging. Products such as powdery building materials, cat litter, washing powders or the like can also be effectively protected against moisture, even under nonoptimum storage conditions. Other products, such as foodstuffs and animal feed, stay fresh for a long time due to the airtight packaging.

In practice, film bags are either made directly before filling in a so-called FFS process (form, fill and seal) or as premanufactured bags intended for subsequent filling. The present invention relates in particular to premade film bags that are subsequently, usually after intermediate storage and transportation, filled and tightly sealed.

Different production methods are known for making prefabricated film bags that are subsequently filled and sealed. The whole film bag can be formed from a single film web by folding. Corresponding film bags are disclosed in EP 1 777 167 and EP 0 341 532 (U.S. Pat. No. 5,048,976).

On the other hand, EP 1 541 332 (U.S. Pat. No. 7,775,957) describes a method of making film bags in which a continuous web of bags is formed in such a way that successive film bags have their long sides or longitudinal edges next to one another. Here, the production direction therefore corresponds to a transverse direction of the individual bags. According to EP 1,541,332, a web is initially formed with successive, initially joined bag blanks. A first film web is guided in the production direction. A strip is then introduced with its edges folded over as flaps onto a middle section of the strip. The folded-over edge flaps are usually of equal width so a central gap remains between the two edges after folding.

Pieces of the strip are then placed on the first film web with equal spacing perpendicular to the production direction (that is to say in the bag longitudinal direction) before a second film is introduced in the production direction and set atop the first film web and the folded-over edge flaps. Longitudinal welds are then made perpendicular to the production direction, by means of which, on the one hand, the folded-over flaps are welded to the second film web at their outer edges, and on the other, to the first film web on the opposite side. Finally, individual film bags are separated from the web so formed by cutting in the region of the strips in such a way that two side gussets of successive film bags are formed from one folded strip.

The material used for the bag film enables a comparatively strong and resistive design of the film bag. In practice, use is made, for example, of multilayer laminated bag films that have a sealing layer of polyolefin forming the bag inner face and an outer layer of polyester, in particular polyethylene terephthalate (PET) or biaxially oriented polypropylene (BO-PP), forming the bag outer face.

As well as the advantages of a good protection and a long storage capability, the tight seal due to the film also has disadvantages. In particular, the tight seal prevents equalization of pressure between the interior of the bag and the external environment. Changes in the air pressure can therefore lead to inflation or contraction of the bag. The contents can also build up a superatmospheric or subatmospheric pressure inside the bag during storage. The result can be chemical reactions or even temperature variations, for example, that expand or contract the contents or the air inside the bag.

When a tightly sealed film bag is transported from a packing location at sea level to a region at higher altitude for example, it inflates on account of the lower air pressure. Inflation is also observed at high ambient temperatures when the air in the package expands, the vapor pressure in the package increases and/or the contents outgases. Under certain circumstances, the effects described can lead to damage or at least to an appearance viewed by a user as unfavorable. With an inflated film bag, the risk of it bursting in the event of mechanical loads, for example if it is dropped or thrown, also increases.

Film bags having a valve or that are continuously ventilated in order to prevent inflation are disclosed in the prior art. However, both variants result in a poorer seal of the film bag, and in addition the installation of a valve is laborious.

As well as inflation of the film bag, in practice, contraction occurs when the pressure inside the bag is reduced compared to ambient pressure. As well as the usual air pressure variations, the packing of contents that are initially warm or hot also leads to a frequently undesirable contraction.

When the film bag is provided with a carry handle, the usual materials for the bag body result in the disadvantage that it can tear if tension is suddenly exerted on the carry handle.

OBJECTS OF THE INVENTION

It is therefore an object of the present invention to provide an improved film bag.

Another object is the provision of such an improved film bag that overcomes the above-given disadvantages, in particular that seals well but is not subject to the above-described expansion and contraction.

SUMMARY OF THE INVENTION

A film bag having a body formed by a plurality of panels, wherein all but one of the panels of the bag body is formed of an inelastic film, and the one panel of the bag body is formed at least partly by an elastic film that can be elastically stretched in at least one direction.

According to a first aspect of the present invention, the a film bag has at least two face panels and two side-gusset panels joining the face panels. Only one of these panels is at least partly made of the elastic film. In accordance with the invention the one panel is in fact one of the side gusset panels Alternatively, it can be only one part of this one side gusset panel, the elastic film then being arranged in a cutout, in particular in a cutout of the inelastic film.

A defined stretch region on the bag body can be provided by the elastic film, the other inelastic panels are not elastically stretchable. In the event of pressure variations, the stretch region formed by part or all of the one panel can then deform to a sufficient extent, i.e. contract or inflate, without the other inelastic panels being adversely affected or the bag damaged.

In particular, the elastic stretchability of the elastic film can be adjusted so that, apart from the defined stretch region, the bag body substantially retains its given shape.

According to a preferred embodiment of the invention, when the film bag has side gusset panels and/or a foldable bottom panel, it is provided that one of the side gusset panels or the foldable bottom panel is formed by the elastic film. The stretch region is then arranged on the film bag in such a way that it is not immediately visible and does not detract from its appearance. One of the side gusset panels or the foldable bottom panel is usually also of a suitable size to provide a sufficiently large stretch region, the material expended for the elastically stretchable and therefore usually highly priced elastic film being still relatively small.

At least one of the side gusset panels or the foldable bottom panel can also particularly easily be designed as a defined stretch region when, as described in EP 1 541 332, the bag body is assembled from a plurality of parts by welds. It is then only necessary to introduce a strip of the elastically stretchable elastic film. Depending on the embodiment of the method, the adjacent side gusset panels of successive bag blanks in a bag web can then be formed together from one folded strip. Against this background, in the case of an embodiment of the film bag with two side gusset panels, it can be expedient to form both side gusset panels from the elastic film. Alternatively, alternate pieces of the elastic film and an inelastic film can also be introduced to form the side gusset panels.

If, on the other hand, the elastic film extends only over part of one of the face panels, one of the side gusset panels or the foldable bottom panel, the corresponding panel is formed from different films. A panel in the form of a side gusset panel, a foldable bottom panel or a face panel can therefore be formed from the first film and the elastic film in such a way that the first film has a cutout that is preferably spanned on a bag inner face by the elastic film, thus forming a stretch region here.

As part of such an embodiment, the film bag can then also easily be formed from one web by folding, wherein—apart from the stretch region—the bag body is formed by the inelastic film. With this production method, a cutout is first formed in a web of the inelastic film and covered by the elastic film before the bag body is formed by folding the film web.

As explained in the introduction, the invention relates particularly to film bags that are initially still not filled following their production as premade bags, wherein, in this case, the side gusset panels are inserted in a V-shape between the face panels. The film bags are subsequently filled and sealed.

However, the embodiment according to the invention is not restricted to film bags that are sealed airtight. An expansion region can also be useful in a film bag with a ventilation device or a valve in order to be able to absorb sudden pressure changes and impacts, for example if the film bag is dropped during handling.

Furthermore, the invention relates to a film bag having a bag body and a carry handle on a panel of the bag that is formed by an inelastic film, the carry handle being fixed on an inner face of the bag body to the inelastic film by means of an elastic film that can be elastically stretched in at least one stretching direction. The bag body is made from the inelastic film by means of the known method described above, but the carry handle is fixed to the bag body by a patch of the additional elastic film. In particular, the tension exerted by a user on the carry handle is transmitted to the bag body by the elastic film.

Sudden changes in tension, for example in the event of the film bag being lifted in a jerky manner, can be damped in this way, as a result of which the risk of tearing the bag body is reduced.

In addition, the carrying comfort for a user is greatly increased, as impacts are cushioned. Large loads can be carried more easily by a user, and the carry handle also cuts into the hand to a lesser extent.

According to a preferred embodiment of the invention, a strip of film is provided as the carry handle, film strip being fixed at its ends to a first side of the elastic film, the elastic film being in turn fixed by its outer face to the bag inner face that is formed by the inelastic film. A strip of film can particularly easily be provided as a carry handle, so that a considerable load can be carried comfortably with a simple patch of elastic film by the embodiment according to the invention.

In order to be able to fix the carry handle to the bag inner face, the inelastic film can have in the region of the carry handle a cutout that is covered from inside the bag by the elastic film patch. The elastic film patch can then also be used as a stretch region in accordance with the first aspect of the invention.

The elastic film is preferably tightly sealed by a weld or adhesive bond around the cutout. The dimensions of the elastic film are chosen to enable a peripheral fixing around the cutout, in particular by thermal welding.

Alternatively, if a simple foil strip is provided as the carry handle, the ends of the foil strip can also be fed inward through cuts in the bag body, an indirect fixing of the ends of the foil strip to the bag inner face by the elastic film thus being provided. A single piece of the elastic film that covers the whole handle region can be provided in the region as a patch of elastic film. When the ends of the patch of elastic film are fed inwards through incisions as the carry handle, a separate, smaller piece of film can also be provided for each of the ends.

The present invention uses the elastic properties of the elastic film to enable a stretch region and/or an elastic attachment of a carry handle. However, the major part of the bag body is formed from the inelastic film that can be in the form of a normal bag film for film bags.

The elastic film does not have to have the same elastic stretchability in all directions. According to the invention, a film is described as elastic when it can be stretched by at least 50% in at least one stretching direction by applying tension, the residual stretch being less than 25% when the tension in the stretching direction is released after stretching by 50%. The inelastic film does not have these properties. It either tears when stretched by 50% or at least has a residual stretch of more than 25% after the tension has been relieved.

The elastic film can preferably be stretched by 100%, particularly preferably by 200%, with a residual stretch of less than 25%.

In order to achieve the elastic properties described, the elastic film has a thermoplastic elastomer, styrene block copolymers and elastic polyolefin copolymers in particular being suitable. Styrene-butadiene-styrene copolymers (SBS) and styrene-isoprene-styrene copolymers (SIS) in particular are considered for the styrene block copolymers.

The elastic film can, in particular, have be a multilayer laminate in order, along with the elastic properties, to also enable a good thermal-welding capability for connecting to the inelastic film. The elastic film is therefore preferably coextruded with at least two layers and, along with the thermoplastic elastomer layer, also has at least one sealing layer made of polyolefin, in particular polyethylene.

The sealing layer is usually inelastic and can be adjusted so that it is only stretched or tears under load the first time the film bag is used. This has the advantage that, without significant pressure loading, the film bag initially behaves conventionally in that the shape of the panel that is made from the elastic film is also unchanged. If, however, a specified load, in particular a permissible overpressure within the film bag, is exceeded, the elastic panel can stretch.

A three-layer construction is particularly suitable, where, however, during manufacture, the panel formed by the elastic film must then be prevented from sticking to itself or, when provided with a carry handle, to an opposite panel during the production process.

The inelastic film is preferably a laminate with multiple layers and has a weld layer made from polyolefin, in particular polyethylene, arranged on a bag inner face, and an outer layer that is selected from a material from the polyester group, in particular polyethylene terephthalate (PET), and biaxially oriented polypropylene (BO-PP), arranged on a bag outer face. Accordingly, the embodiment is a well-known and proven embodiment of a conventional bag film that, for example, can also be provided with an internal inscription that is made before laminating.

BRIEF DESCRIPTION OF THE DRAWING

The above and other objects, features, and advantages will become more readily apparent from the following description, reference being made to the accompanying drawing in which.

DETAILED DESCRIPTION OF THE INVENTION

Figure 1:
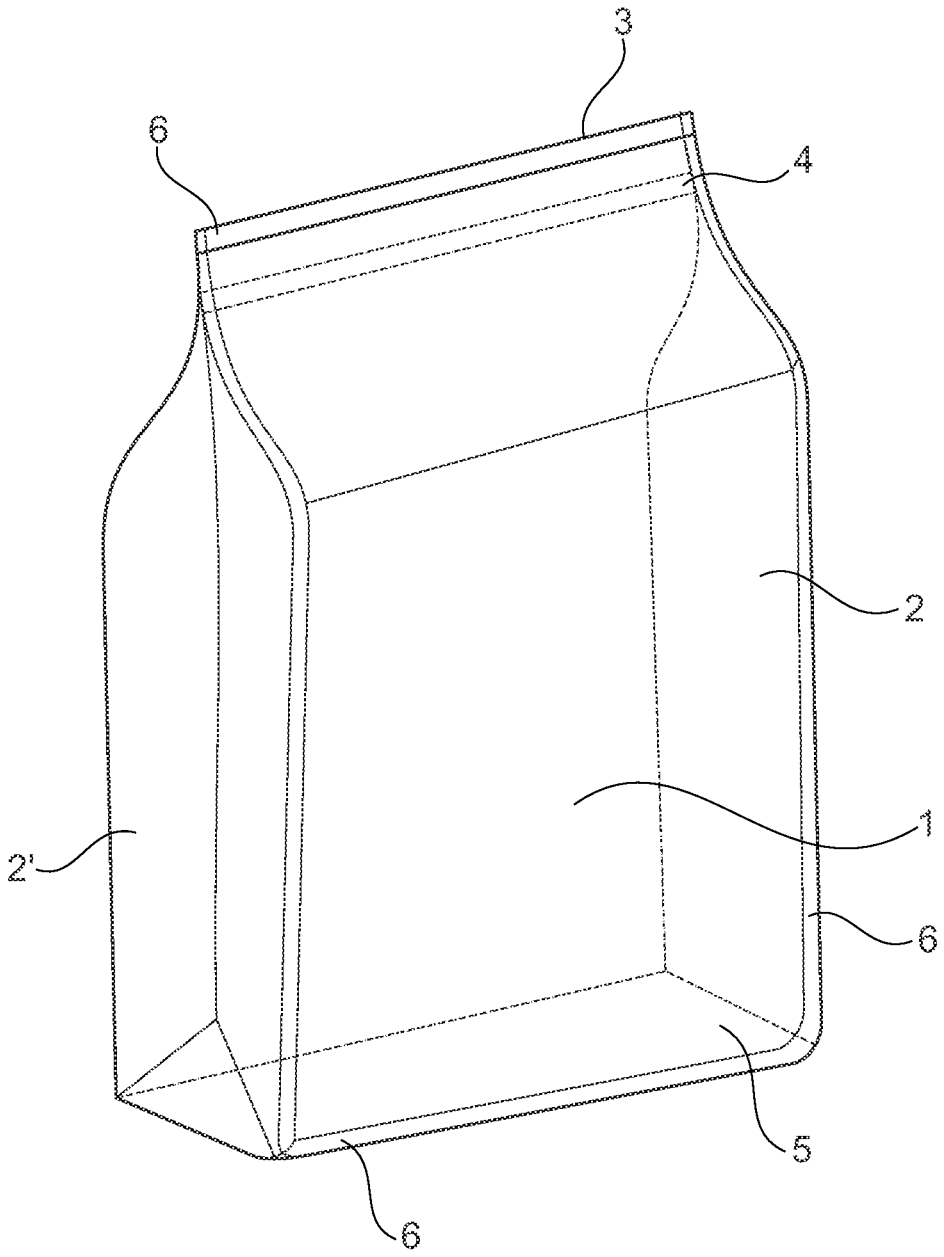
FIG. 1 is a perspective view of a film bag.

As seen in FIG. 1 a film bag according to the invention has a bag body comprising two face panels 1 and two side gusset panels 2 and 2' between the face panels 1 and secured to longitudinally extending side edges thereof. The film bag can be torn open at an upper edge 3 where the two panels 2 are joined. A reclosable fastener 4 below the upper edge 3 is formed, for example from profile strips that can be fitted to each other.

A standing base is formed opposite the bag head 3 by a foldable bottom panel 5 secured to lower edges of the face panels 1 and of the side gusset panels 2 and 2'. Alternately, a standing base can also be formed by folding in lower regions of the face panels 1.

In the embodiment shown, the different panels of the film bag, that is to say the face panel 1, the side gusset panels 2 and 2' and the foldable bottom panel 3, are connected and joined together by welds 6. A production method ("Totani method") disclosed in EP 1 541 332 (U.S. Pat. No. 7,331, 917) is particularly suitable.

According to the invention, one panel of the film bag, in this embodiment one of the side gusset panels 2', is formed from a second, elastic film, while the other inelastic panels, that is to say the other side gusset panel 2, the face panels 1 and the foldable bottom panel 5, are formed from an inelastic film. The inelastic film is preferably a conventional bag film whose structure is explained below with reference to FIG. 3B.

Pressure differences between the interior and the environment of the film bag can be compensated at least to a certain extent by the elastically stretchable side gusset panel 2', even in the case of a completely sealed structure. A pressure increase inside the film bag therefore leads to an elastic expansion of the appropriate side gusset panel 2' without the film bag bursting and/or the welds 6 being torn open. When the pressure difference subsequently subsides, the side gusset panel 2' formed by the elastic film returns to its original relaxed shape.

As well as slow pressure changes, sudden pressure surges, for example in the event of a blow against the film bag, can also be compensated without damage to the film bag.

Figure 2:
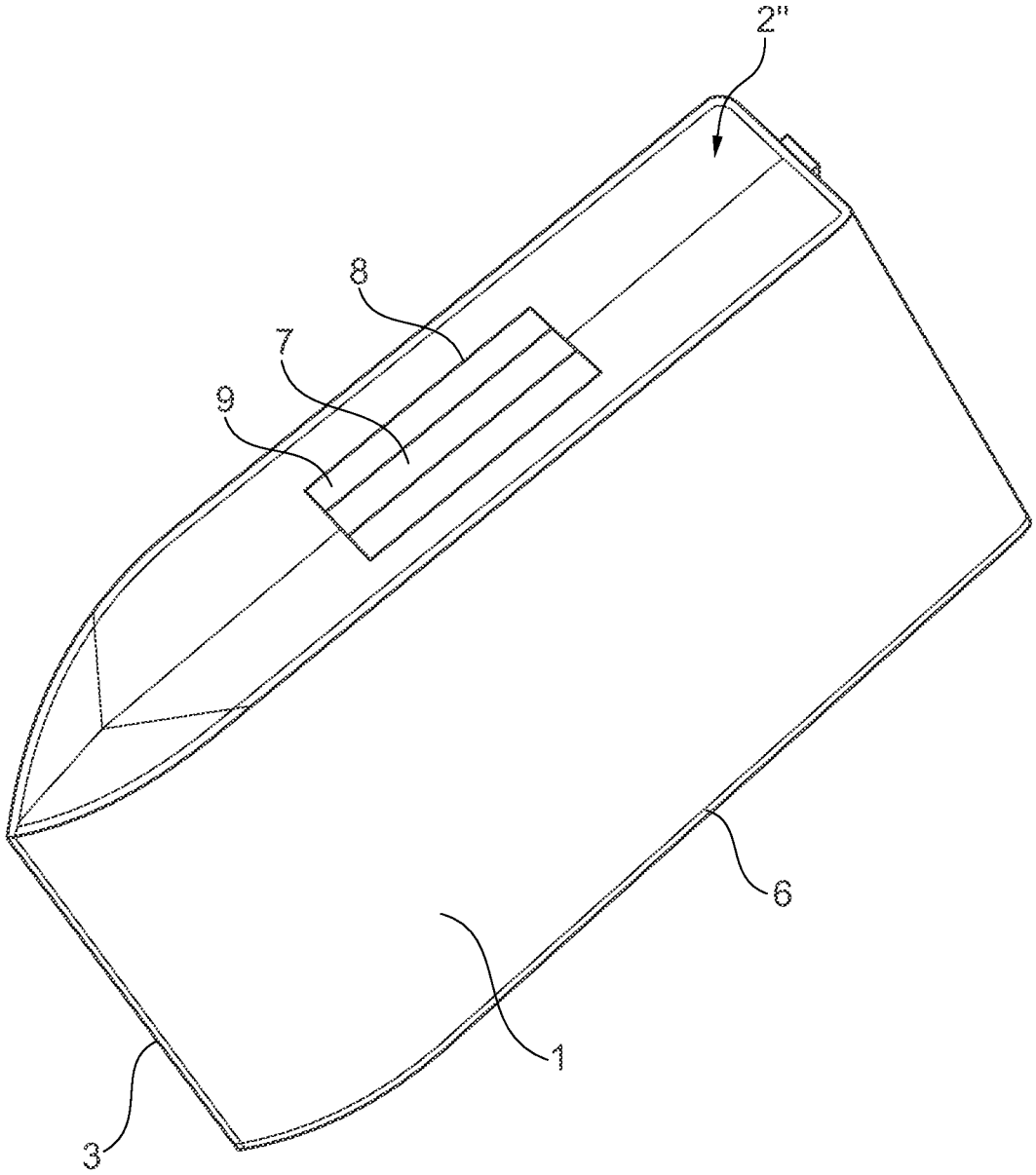
FIG. 2 is a perspective view of a film bag with a carry handle.

FIG. 2 shows a film bag having gusset panels 2 and 2" with a carry handle 7 that is formed by a simple film strip. In this embodiment, both face panels 1 as well as both side gusset panels 2 and 2" are formed from the inelastic film, and the carry handle 7 is mounted in a cutout 8 of the side gusset panel 2". The cutout 8 is sealed with respect to the interior of the bag by the second, elastic film patch 9 that forms a defined stretch region exactly like one of the side gusset panels 2' in the embodiment of FIG. 1, is formed within the cutout.

In the event of superatmospheric or subatmospheric pressure inside the film bag, this stretch region can easily deform in order to at least partially compensate for the pressure difference. The cutout 8 with the elastic patch 9 formed therein by the elastic film can accordingly be advantageous even without the carry handle 7.

If, on the other hand, a carry handle 7 is provided, then, according to a further aspect of the present invention, it is only fixed indirectly to the bag body, in particular to an inner face 10 of the bag body, by the elastic film patch 9. Even if the carry handle 7 is formed from a stiff, nonstretchable material, the second, elastic film cushions sudden changes in the tension on the carry handle 7, for example when the film bag is lifted in a jerky manner. At the same time, the elastic film acts as a buffer between the carry handle 7 and the bag body formed by the panels 1, 2, 2', and 5, as a result of which the carrying comfort for a user is also significantly increased.

Figure 3A:
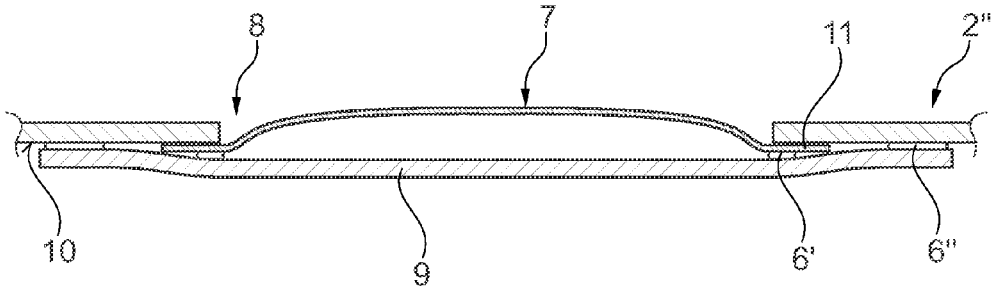
FIG. 3A is a longitudinal section through the film bag shown in FIG. 2 in the region of the carry handle.

FIG. 3A illustrates the fixing of the carry handle 7, where the ends 11 of the carry handle 7 are fixed to the elastic film patch 9, preferably by welds 6'. For its part, the elastic film patch 9 is fixed to the bag inner face 10 formed by the inelastic film by a further weld 6" that preferably runs annularly all around the cutout 8.

Figure 3B:
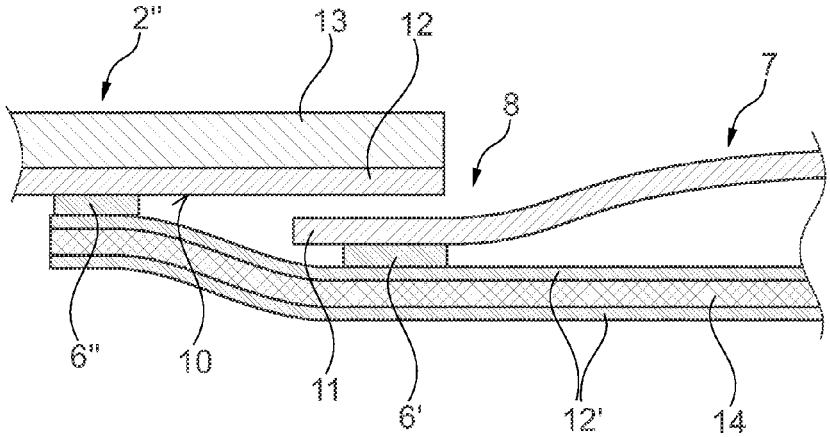
FIG. 3B shows a detail of FIG. 3A.

According to FIG. 3B, the inelastic film is a laminate formed by an inner sealing layer 12 made from polyolefin, in particular polyethylene, forming the bag inner face 10, and an is outer layer 13 forming a bag outer face. The outer layer 13 can be formed, for example, from polyester, in particular polyethylene terephthalate (PET) or from biaxially oriented polypropylene (BO-PP), so that printing done before the lamination process can also be provided between the layers that are laminated together.

In the embodiment of FIG. 3B, the elastic film of the patch 9 is coextruded with three layers, namely an elastic core layer 14 based on styrene block copolymer sandwiched between outer sealing layers 12' of polyolefin, in particular polyethylene. The welds 6' secure ends 11 of the carry handle 7 to the outer face of the elastic film patch 9 that in turn is fixed by the welds 6" to the bag inner face 10, so that both welds 6 and 6' are only formed on one of the two sealing layers 12'. Accordingly, a two-layer structure is basically sufficient.

The at least one sealing layer 12' of the elastic film is usually inelastic, whereas the return of the whole elastic film to its rest-position shape is achieved by the elastic core layer 14. In order to enable the elastic film to be stretched easily, it can be activated, i.e. prestretched, before the bag body is formed, in that the at least one sealing layer 12' is stretched or even partially torn for the first time when increased force is applied.

Alternatively, the force necessary for the initial stretching can also be specifically applied so that the elastic properties only come into play when a predetermined tension is exceeded in the elastic film.

In order to fulfill the functions provided according to the invention, it is sufficient for the elastic film to be is elastically stretchable in only one direction, and accordingly a suitable alignment of the elastic film must then be observed. When a carry handle 7 is attached, the second foil must therefore be stretchable in the direction of the tension that will be applied to it, typically longitudinally of the bag.

Figure 4:
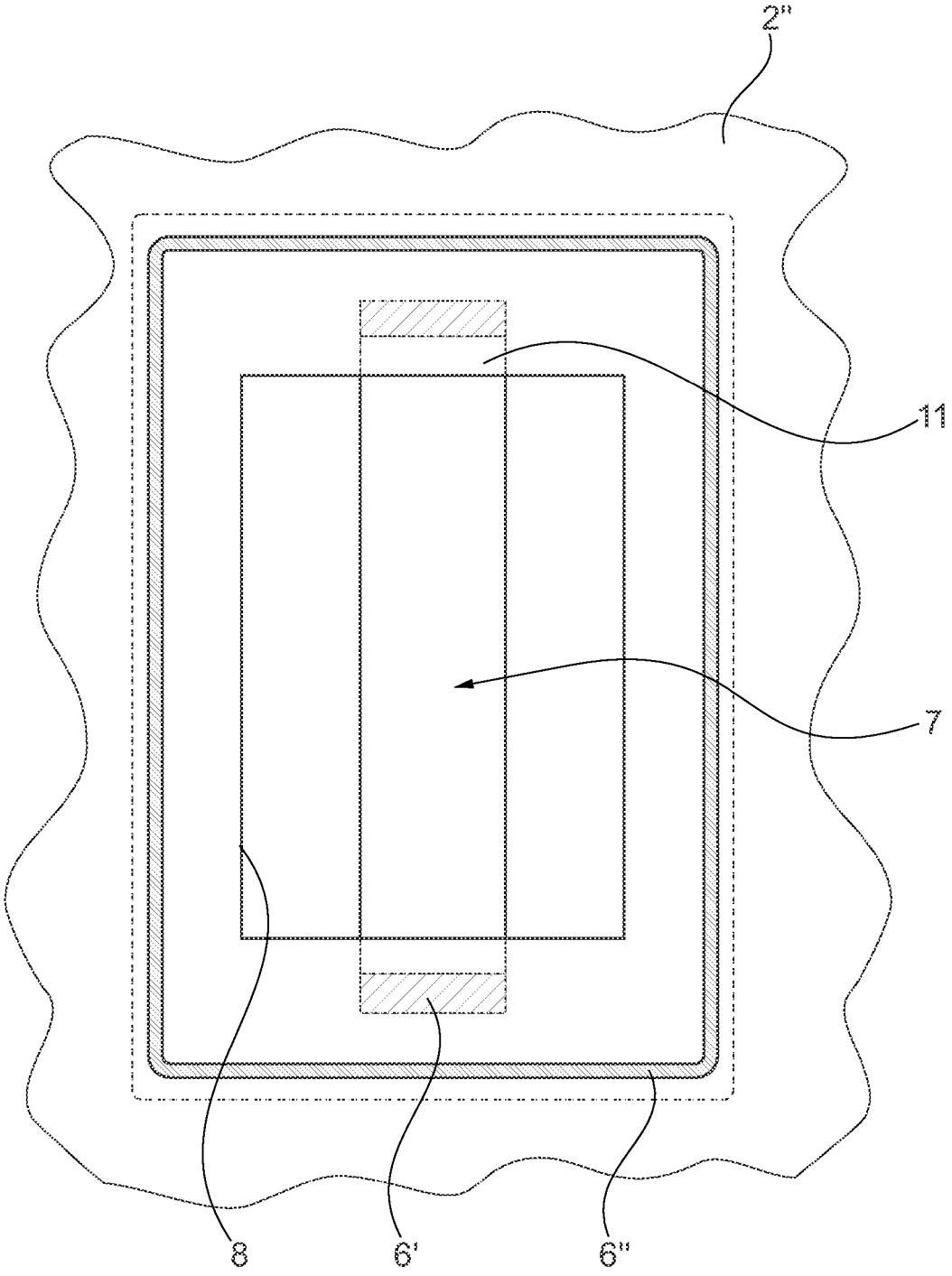
FIG. 4 is a detail view of the region of the carry handle of the film bag according to FIG. 2 in a plan view.

FIG. 4 shows the region of the carry handle 7 in a plan view. The elastic film patch 9 is suitably oversized compared with the cutout 8 to provide a solid peripheral connection to the bag inner face 10 by the weld 6".

We claim:

1. A film bag having a body formed by a pair of face panels, a pair of side gusset panels joined to the face panels, and a foldable bottom panel joined to the side gusset panels and face panel, wherein all of both of the face panels and all of one of the side gusset panels are formed of an inelastic film, and all of the other side gusset panel is formed by an elastic film that can be elastically stretched in at least one direction.

2. The film bag defined in claim 1, wherein the other side gusset panel is the panel formed by the elastic film.

3. The film bag defined in claim 1, wherein the foldable bottom panel is formed from the elastic film.

4. The film bag defined in claim 1, wherein the elastic film has at least one layer of styrene block copolymer.

5. The film bag defined in claim 4, wherein the elastic film is coextruded with at least two layers and, along with the layer based on styrene block copolymer, also has at least one sealing layer made of polyolefin.

6. The film bag defined in claim 5, wherein the inelastic film is a laminate having a sealing layer made from polyolefin on a bag inner face and an outer layer that is of polyethylene terephthalate or biaxially oriented polypropylene on a bag outer face.

7. A film bag having a body formed by a plurality of panels, wherein all but one of the panels of the bag body are formed of an inelastic film, and the one panel of the bag body is formed with an aperture, provided with a patch of a stretchable elastic film adhered at the aperture to an inner face of the one panel, provided with a handle secured to the patch and exposed through the aperture, and formed entirely of an elastic film.

8. The film bag defined in claim 7, wherein the patch of the elastic film is adhered all around an inner edge of the aperture to the one panel and thereby closes and seals the aperture.

9. The film bag defined in claim 7, wherein the handle is secured to the patch and therethrough to the one panel.

10. The film bag defined in claim 9, wherein the handle is secured to an outer face of the patch and the outer face of the patch is peripherally secured to the inner face of the one panel around the cutout.

* * * * *